US008161690B1

(12) United States Patent
Borne et al.

(10) Patent No.: US 8,161,690 B1
(45) Date of Patent: Apr. 24, 2012

(54) INTERLOCKING PORTABLE ROLLOUT ATTIC FLOORING WITH OVERLAPPING PLANKS

(76) Inventors: Lynn Eric Borne, Glendale, CA (US); Lynn Charles Borne, Agoura, CA (US)

( * ) Notice: Subject to any disclaimer, the term of this patent is extended or adjusted under 35 U.S.C. 154(b) by 431 days.

(21) Appl. No.: 12/456,937

(22) Filed: Jun. 23, 2009

(51) Int. Cl.
*E04B 5/04* (2006.01)

(52) U.S. Cl. ..... 52/71; 52/591.4; 52/177; 52/480; 52/483.1; 404/35; 428/54; 428/60

(58) Field of Classification Search ..... 52/71, 591.4, 52/177, 778, 779, 480, 483.1, 222, 223.7, 52/343; 404/35, 36; 160/230, 231.1, 232.2; 428/54, 60
See application file for complete search history.

(56) References Cited

U.S. PATENT DOCUMENTS

| | | | | | |
|---|---|---|---|---|---|
| 3,913,291 | A | * | 10/1975 | Dulien et al. | 52/396.04 |
| 4,242,390 | A | * | 12/1980 | Nemeth | 428/47 |
| 4,568,587 | A | | 2/1986 | Balzer | |
| 4,654,245 | A | | 3/1987 | Balzer et al. | |
| 4,681,482 | A | * | 7/1987 | Arciszewski et al. | 404/35 |
| 4,877,672 | A | | 10/1989 | Shreiner | |
| 5,033,241 | A | | 7/1991 | Max | |
| 5,059,476 | A | * | 10/1991 | Steiniger et al. | 428/217 |
| 5,213,861 | A | * | 5/1993 | Severson et al. | 428/52 |
| 5,239,790 | A | | 8/1993 | Fetzer | |
| 5,342,141 | A | * | 8/1994 | Close | 404/28 |
| 5,540,025 | A | * | 7/1996 | Takehara et al. | 52/403.1 |
| 6,558,765 | B2 | * | 5/2003 | Padmanabhan | 428/54 |
| 6,874,972 | B2 | * | 4/2005 | Davis et al. | 404/35 |
| 6,968,652 | B1 | | 11/2005 | Eadie | |
| 7,108,902 | B2 | | 9/2006 | Ellingson | |
| D539,933 | S | | 4/2007 | Fischer | |
| 7,303,801 | B2 | * | 12/2007 | Kessler | 428/54 |
| 7,389,614 | B2 | | 6/2008 | Sullivan | |
| 7,424,794 | B2 | * | 9/2008 | Baranowski | 52/483.1 |
| 7,752,820 | B2 | * | 7/2010 | Deschamps | 52/383 |
| 2006/0075711 | A1 | | 4/2006 | Landey | |
| 2007/0062147 | A1 | | 3/2007 | Wright | |

* cited by examiner

*Primary Examiner* — Robert Canfield
*Assistant Examiner* — Jody Giacoman
(74) *Attorney, Agent, or Firm* — Patent Law & Venture Group; Gene Scott

(57) ABSTRACT

An interlocking portable rollout attic flooring having a plurality of planks laid in a mutual abutting relationship of side edges of the planks, to define a common longitudinally extensive top and bottom surfaces, the common bottom surface having longitudinally directed notches oriented orthogonal to the side edges. The longitudinally directed notches engaged with spaced apart beams for support and stability of the flooring. The side edges of the planks configured in a mutually overlapping relationship wherein each plank supports a portion of weight applied to each adjacent plank. At least one longitudinally directed flexible strap fixed to the top surface of the flooring to secure the planks in the abutting relationship while allowing the planks to be rolled into a cylindrical configuration.

10 Claims, 5 Drawing Sheets

INTERLOCKING PORTABLE ROLLOUT ATTIC FLOORING WITH OVERLAPPING PLANKS

BACKGROUND OF THE INVENTION

1. Field of the Present Disclosure

This disclosure relates generally to attic flooring structures and more particularly to a portable flooring for supporting individuals and storage materials on attic beams and joists.

2. Description of Related Art Including Information Disclosed Under 37 CFR 1.97 and 1.98

Wright, US 2007/0062147 discloses a portable folding floor unit with two or more sections, each of the sections being essentially identical rectangular planar sections. The sections are connected to one another along their lengths with the use of hinges, providing a flooring unit that can fold up in an accordion style for easy transportation and use. An alternate embodiment of the portable folding floor unit has two rectangular planar end sections with protruding hinge pieces along one length. A series of middle sections are provided with protruding hinge pieces along opposing lengths such that the two end sections and middle sections can be interlocked. A series of rods can be placed through the interlocking hinge pieces to produce the portable folding floor unit with an accordion style folding.

Landey, US 2006/0075711 discloses an Attic Floor Joist Grid System for Weight Bearing Storage called an Attic Grid System. This system features low profile, flat, open and high strength grid panels that are supported by a joist system. The panels install directly onto the ceiling joists in an attic or storage area for residential and commercial applications. The panels are nominal widths that extend essentially to the center points of supporting joists. The system provides a simple and strong support surface which only requires simple, easy to use tools for installation. The panels are easily trimmed to size for non-standard operations and for encircling mechanical and electrical objects. The system is "see-through" and permits full air movement. Hence it does not contribute to moisture entrapment, mold and mildew. The materials are fire resistant and do not collapse or emit toxic fumes in the presence of a flame.

Sullivan, U.S. Pat. No. 7,389,614 discloses herein a rack apparatus and storage panel assembly for implementing across two or more beams. The storage panel assembly is most typically implemented in attic storage space lacking a flooring surface on which to place and store items. The storage panel assembly comprises at least one rack apparatus, two or more railings to be positioned onto a series of rack apparatus and a panel configured to rest on two parallel railings. The assembly provides a continuous platform by sitting between the truss creating a planer surface between the top of the panel and the top of the truss. The method of assembly allows positioning of the rack apparatuses between the truss connections and allows the railings and panel to slide under any transverse obstructions bearing on top of truss.

Fischer, US D539933 discloses the ornamental design for an attic flooring extrusion.

Ellingson, U.S. Pat. No. 7,108,902 discloses a commercial floor mat with a plurality of aluminum rails arranged in closely spaced side-by-side relationship and connected together by hinged connectors beneath the rails. Each rail has a pair of downwardly facing grooves on its underside extending along respective edges of the rail. Each connector has a flexible central web and a pair of spaced upstanding tabs disposed in the downwardly facing grooves of adjacent rails. The tabs have flexible barb-shaped ribs extending along their opposed faces to anchor the tabs in the grooves with a friction fit. The flexible central webs of the connectors facilitate hinged movement of connected rails to permit the mat to be rolled onto itself into a compact configuration.

Eadie, U.S. Pat. No. 6,968,652 discloses a flooring device for positioning on joists so as to allow for easy maneuvering on floor joists in an attic. The flooring device includes a plurality of substantially rigid panels arranged adjacent to each other in a series. The invention also includes a connecting mechanism located at a juncture between each of the panels in the series for connecting each panel to an adjacent panel. The connecting mechanism permits adjacent panels of the series to pivot about a pivot axis with respect to each other, with the pivot axis of the mechanism at one juncture of the series being positioned adjacent to the top sides of the panel adjacent to the juncture and the pivot axis of the mechanism at an adjacent juncture being positioned adjacent to the bottom side of the panels adjacent to the juncture such that the series of panels are foldable in accordion fashion between collapsed and extended conditions.

Fetzer, U.S. Pat. No. 5,239,790 discloses a preassembled attic shelf unit, which includes a pair of shelf support members connected to each other with wooden connectors, so that outward facing surfaces of the support units are engageable with portions of adjacent roof trusses located on fixed centers. Each shelf support member may be rectangular wooden stock material formed with an elongate rectangular groove in an inward facing surface thereof so that the opposing grooves respectively receive longitudinal edges of the shelf in sliding supporting engagement. Nails may be utilized to fasten the shelf supporting members directly to the portions of the trusses such as web member portions interconnecting top and bottom chord members of the trusses together.

Max, U.S. Pat. No. 5,033,241 discloses a portable, foldable dance floor having a top surface of parquet panelling mounted on a flat plywood base, and composed of identical half-sections which open horizontally on a flat surface and close vertically parallel to each other.

Shreiner, U.S. Pat. No. 4,877,672 discloses a floor mat which is composed of a multiplicity of rigid elongated rails arranged parallel to each other, each rail having a body portion adapted to receive a tread member and a coupling portion by which it is joined to an adjacent rail. The body and coupling portions are found by extrusion of a rigid high-impact strength thermoplastic polymeric material and are joined by a living hinge of a highly flexible thermoplastic elastomer formed by coextrusion with the body and coupling portions. Each rail includes at least two ribs along its underside laterally spaced apart from each other and adapted to support the rail on a surface, each rib being formed by coextrusion with the body and coupling portions and the living hinge of a soft, compressible thermoplastic polymeric material and serving as a cushion and an anti-slip element of the mat.

Balzer et al., U.S. Pat. No. 4,654,245 discloses a roll up floor mat with rails or sections hingedly interconnected by alternating, flexible strips, which, in turn serve to cushion the mat by use of laterally extending flaps interposed between the floor or other supporting surface and the rail sections, the flaps being integral with the hinge assemblies between the sections.

Balzer, U.S. Pat. No. 4,568,587 discloses a floor mat which includes a plurality of rigid, elongated rails each having a side edge positioned in substantially parallel, spaced relationship to a respective side edge of an adjacent rail. A passageway opens inwardly from each rail side edge and includes an outer portion adjacent to the side edge and an inner portion. The passageway inner portions have greater cross-sectional dimensions than the passageway outer portions. Each pair of adjacent rails is interconnected by an elongated, flexible hinge member which is comprised of a pair of opposite, spaced flanges extending longitudinally with respect to the hinge member. The flanges are interconnected by a web having a cross-sectional thickness less than a cross-sectional thickness of each of the flanges. The hinge member flanges are each slidably received in a respective passageway inner portion. The hinge member is adapted to maintain the rails in a substantially parallel, predetermined spacing and to bend transversely with respect to the rails thereby allowing transverse angular displacement of the rails relative to each other.

The related art described above discloses solutions to the need for attic surfaces for storage and other needs. Wright and Eadie each teaches a plurality of boards that are abutted and joined along their long edges by hinges so that they may be folded accordion style when not in use and can be laid flat when installed on attic joists. Balzer, Balzer et al, Shreiner and Ellington each teaches a roll out mat that may be used for attic flooring. These structures are complex and of questionable practicality due their expense in production and assembly. The prior art fails to disclose an inexpensive and self stabilized relatively simple structure useful as a roll-out attic flooring that requires no installation hardware. The present disclosure teaches such an apparatus and its use and therefore distinguishes over the prior art providing heretofore unknown advantages as described in the following summary.

BRIEF SUMMARY OF THE INVENTION

This disclosure teaches certain benefits in construction and use which give rise to the objectives described below.

An interlocking portable rollout attic flooring having a plurality of planks laid side-by-side in a mutual abutting relationship of side edges of the planks, thereby defining a common, continuous, longitudinally extensive, top and bottom surfaces, the common bottom surface having longitudinally directed notches oriented orthogonal to the side edges. The longitudinally directed notches engaged with spaced apart beams for support and stability of the flooring. The side edges of the planks configured in a mutually overlapping relationship wherein each plank supports a portion of weight applied to each adjacent plank. Preferably, two longitudinally directed and spaced apart flexible straps fixed to the top surface of the flooring to secure the planks in the abutting relationship while allowing the planks, alternatively, to be rolled into a cylindrical bundle configuration for easily carrying the flooring. A shoulder strap may be attached to one of the planks.

A primary objective inherent in the above described apparatus and method of use is to provide advantages not taught by the prior art.

Another objective is to provide an assembly of planks providing a utility surface capable of being walked on or supporting the weight of stored items.

Another objective is to provide such an assembly that is easily installed on attic beams without tools for fasteners.

Another objective is to provide such an assembly that is able to nest with the attic beams or joists so as to prevent lateral movement of the assembly after installation.

Another objective is to provide such an assembly that is capable of being rolled into a compact form secured by a circumferential strap and carried using an integral shoulder strap.

Another objective is to provide such an assembly wherein adjacent planks have overlapping edges so that weight is distributed from each plank to an adjacent neighbor plank.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
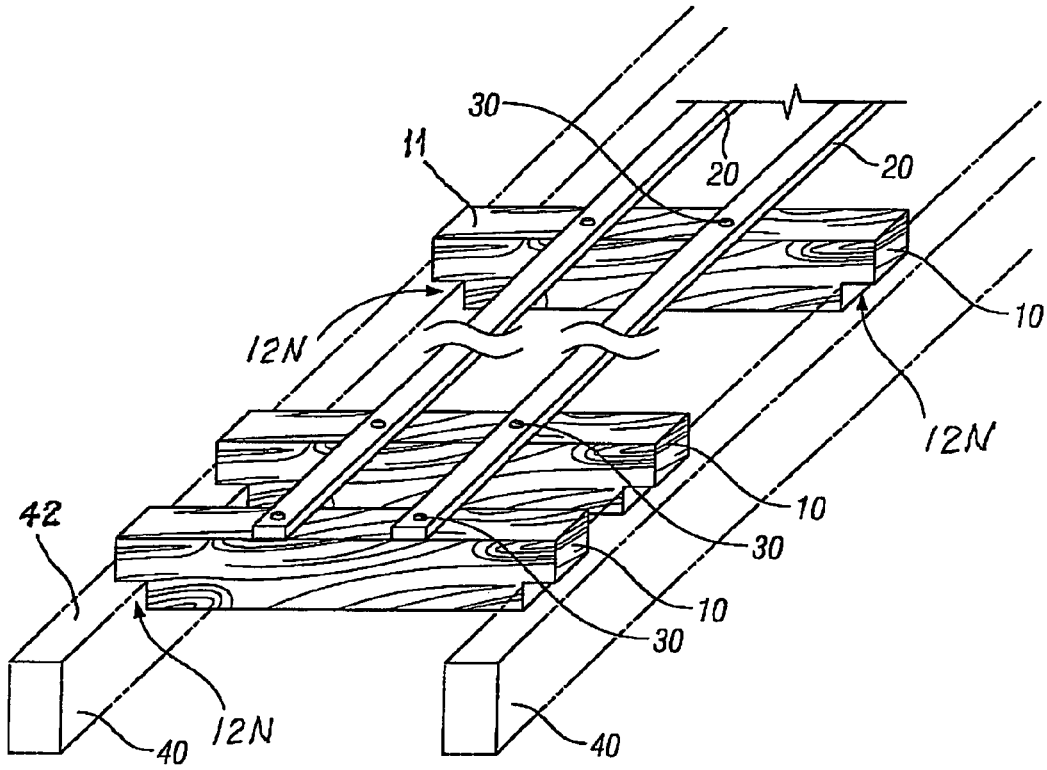
FIG. 1 is a perspective view of one embodiment of the presently described apparatus wherein planks are spaced apart and each of the planks is notched at both ends for securement on beams while preventing lateral movement of the planks.
Figure 2:
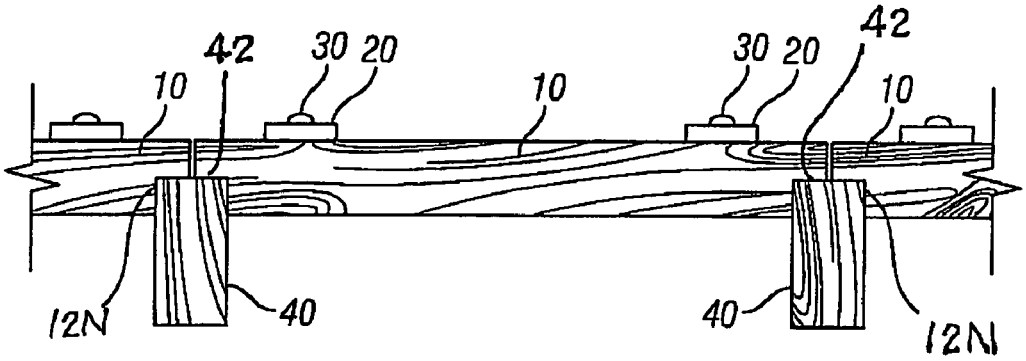
FIGS. 2 is an elevational end view of the embodiment of FIG. 1, further showing the engagement of the planks with the beams.
Figure 3:
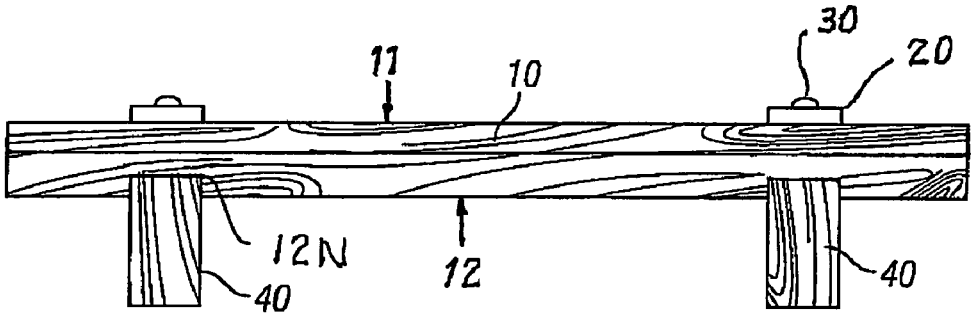
FIG. 3 is a further elevational end view of a second embodiment of the present invention wherein the planks are notched for spanning and overlapping adjacent beams.
Figure 4:
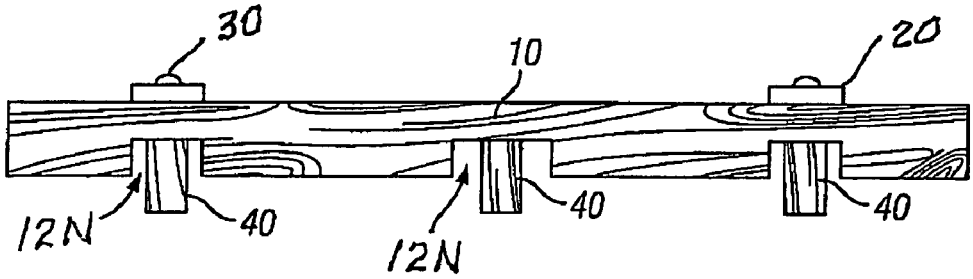
FIG. 4 is a still further elevational end view of a third embodiment of the present invention the planks are notched for spanning multiple beams.
Figure 5:
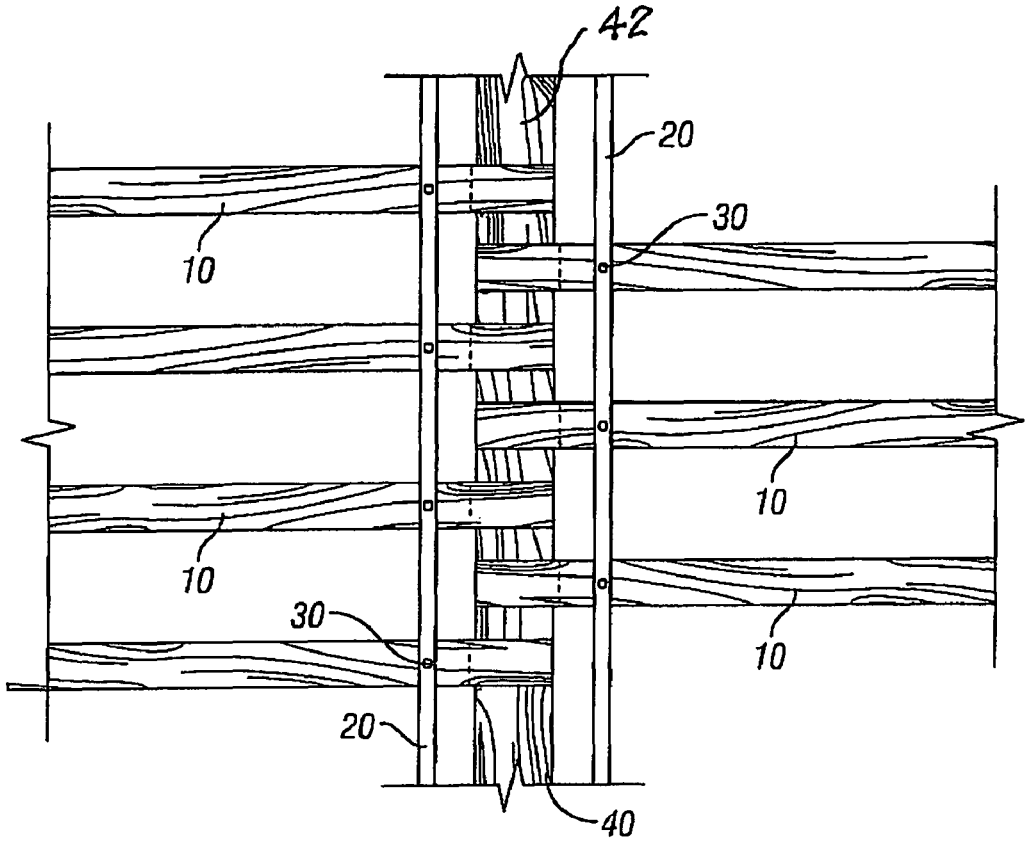
FIG. 5 is a plan view of a fourth embodiment of the present invention wherein two plank assemblies are positioned side-by-side with their mutually adjacent ends resting on a common beam and wherein the adjacent ends of the planks are in alternating interleaved positions.
Figure 6:
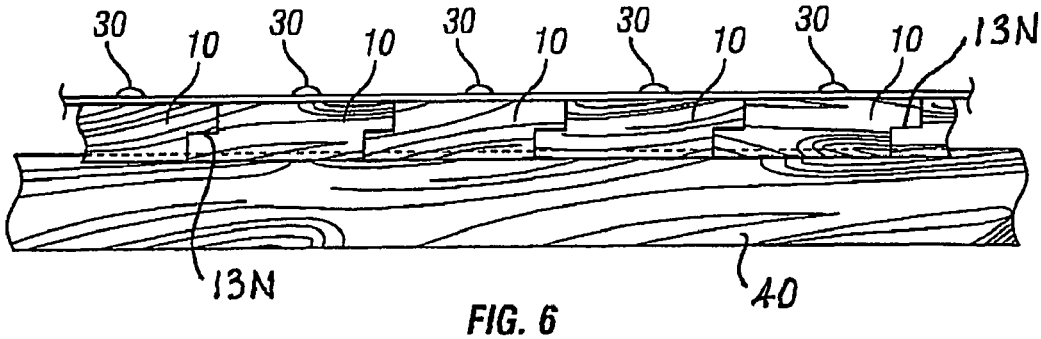
FIG. 6 is a side elevational view of a fifth embodiment wherein side edges of the planks are mutually nested and overlapped.
Figure 7:
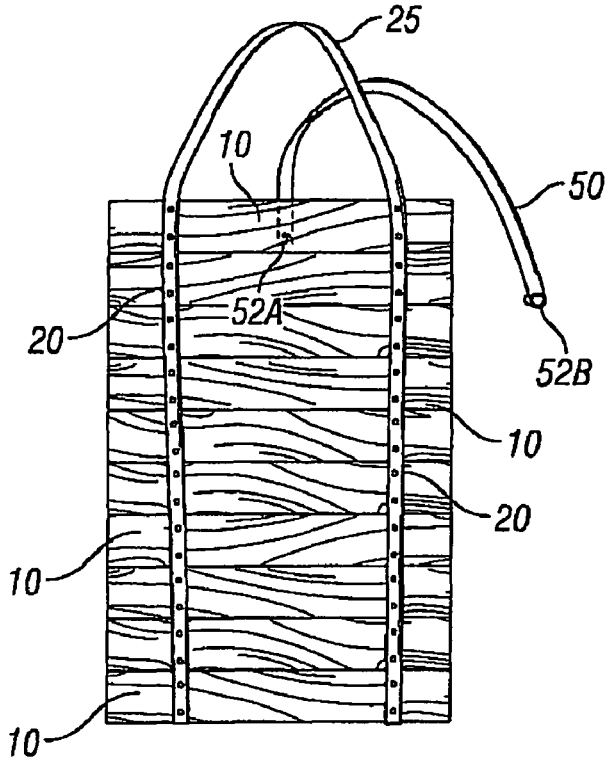
FIG. 7 is a top plan view of the arrangement of FIG. 6 showing a shoulder strap and a circumferential strap attached to the planks.
Figure 8:
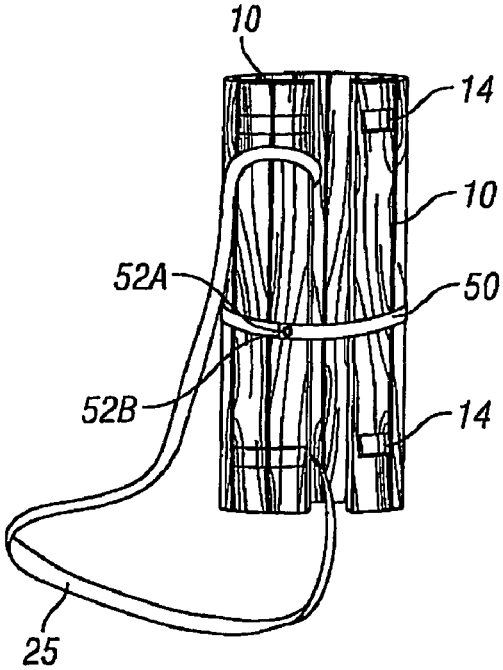
FIG. 8 is an elevational view of the embodiment of FIG. 6 wherein the planks are vertically oriented, rolled up, and secured by the circumferential strap.
Figure 9:
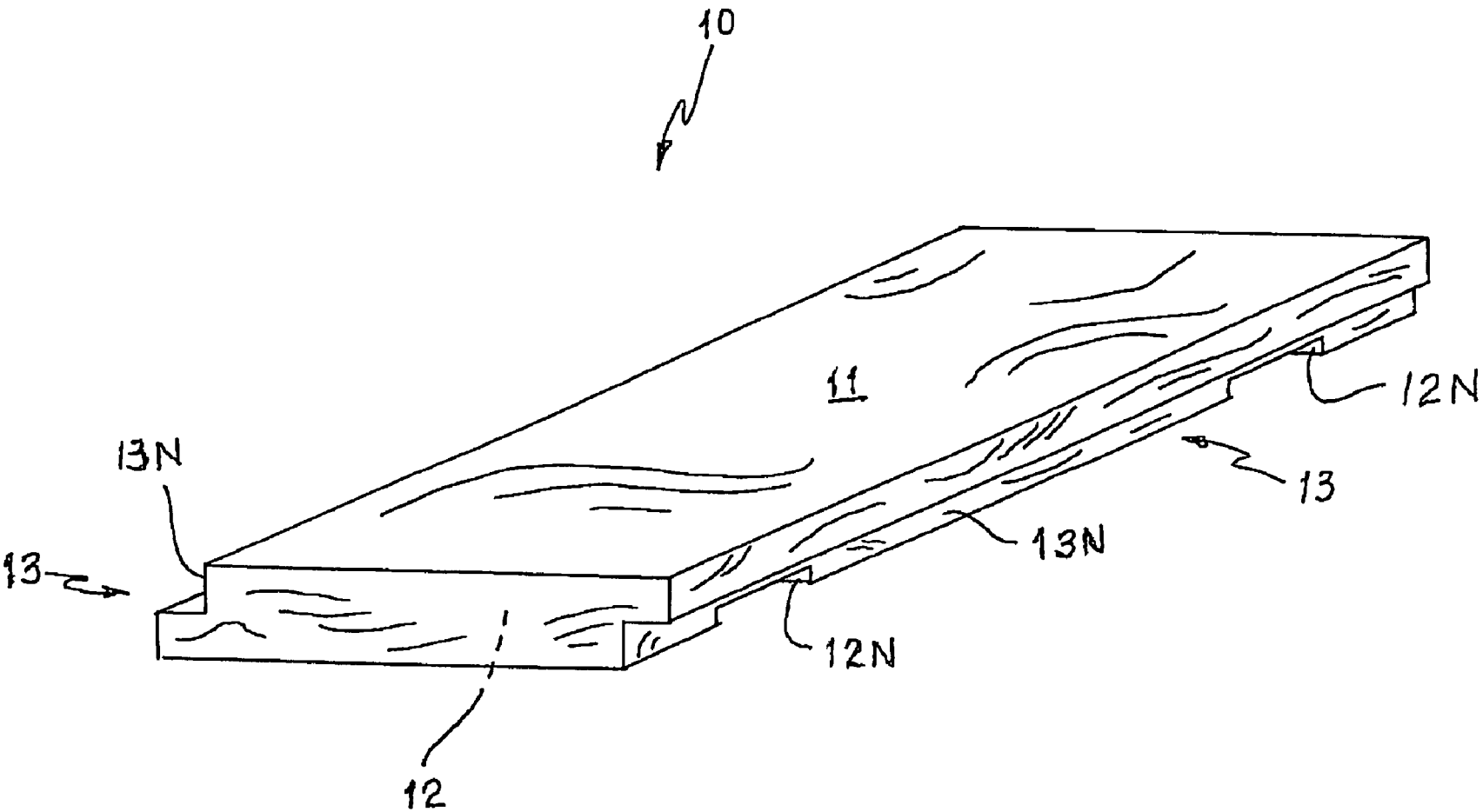
FIG. 9 is a perspective view of one of the planks of FIG. 6.

In a preferred embodiment of the present invention, as shown in FIGS. 3, 6, 7, 8 and 9, an interlocking portable rollout attic flooring with overlapping planks 10 is defined as an assembly. The planks 10 are preferably made of wood or plastic and may be mill cut or extruded to a final configuration. The planks 10 may be made of other structural materials as well. The planks 10 are preferably arranged in a side-to-side edge abutting series as shown in FIGS. 6 and 7 and are laid out, when deployed, in a longitudinal arrangement. The planks may also be non-abutting as shown in FIGS. 1 and 5. As shown in FIG. 9, each plank 10 has a top surface 11 and a bottom surface 12, opposing side edges 13, and side edge notches 13N which extend along and are integral with side edges 13. The planks 10 each also have at least one pair of longitudinally oriented and spaced apart bottom surface notches 12N. Notches 12N may be L-shaped, as shown in FIGS. 1 and 2, or U-shaped as shown in FIGS. 3, 4 and 9. Notches 13N are L-shaped as shown in FIGS. 6 and 9.

From FIGS. 6 and 9 we see that the top surface 11 is contiguous with one notch 13N along one side edge 13, while the bottom surface 12 is contiguous with a second notch 13N along the opposing side edge 13. In this manner, when the edges 13 of adjacent planks 10 are mutually engaged, each plank 10 shares loads with one adjacent plank 10 other than a plank 10 that is positioned at the end of the series of planks 10. In this embodiment, straps 20 are engaged with planks 10 to assure that planks 10 are mutually engaged.

As shown in FIG. 7, two longitudinally oriented straps 20 of a non-elastic, flexible material such as nylon strapping are engaged with all of the planks 10 on their top surfaces 11. Preferably, the two straps 20 are joined in a loop 25 at one end of the assembly. Straps 20 may be engaged with planks 10 in many ways such as by nail or brad fasteners 30 shown in FIG. 6. As shown in FIG. 7 a further strap 50 may be engaged with one of the planks 10 and the further circumferential strap 50 is long enough to extend around the planks 10 when they are rolled-up into a coiled shape or bundle as shown in FIG. 8. The ends of circumferential strap 50, when drawn around the coiled planks 10, are mutually fastened using hook and loop fastener material, snaps 52A and 52B, or by other common fastening means. When coiled and fastened, as shown in FIG. 8, the assembly is easily carried by its shoulder strap; loop 25.

In an alternate embodiment shown in FIG. 1, the present invention includes a pair of spaced apart, horizontally oriented, beams 40 such as ceiling joists which extend longitudinally and are fixed in place relative to a building structure (not shown). Such beams 40 are typically made of wood or metal and are arranged in mutually parallel positions and spaced apart according to building codes, as for instance on 16" centers. Each of the beams 40 has an upwardly facing, top beam surface 42.

The plurality of spaced apart, mutually parallel planks 10, are laid across and rested on the beams 40. Depending on the weight that planks 10 must support, they may vary in thickness, rigidity, specific gravity and strength. Planks 10 are considered to be structural members capable of supporting an individual standing or walking on them, or supporting storage materials, such as boxes of heavy items such as books, dishes, etc.

In FIG. 1, strips 20 are shown as preferably mounted on the top surface 11 of planks 10, but they may be mounted just as easily on the bottom surface 12 or even on the ends of planks 10. Also, strips 20 are shown as relatively narrow bands, however, they may be broader and may even be as long as the planks 10, depending on the utility service. Therefore, in this disclosure, although we discuss two strips 20, it should be understood that the strips 20 may be of any size, number, attachment means, and may be attached to the planks 10 in any way known to those of skill in the art, as long as the planks are held by the strips 20 in their desired locations and sequence. FIG. 1 shows one embodiment of the present invention whereby strips 20 are secured to planks 10 by nails, brads, screws or other common hardware.

A key and important feature of the present invention is that at least one of the planks 10, and preferably all of them, has a surface conformation that thwarts or prevents disengagement of the planks 10 from the beams 40 by lateral motion of the planks 10. This is a critical feature since when walking atop the planks 10, or when sliding boxes or other storage materials around on the top surfaces 11 of the planks 10, lateral forces may be applied to the planks 10 and this may cause them to move laterally and thereby lose contact with one or both beams 40. Should this happen, whatever is supported by the planks 10 may fall between beams 40 and possibly damage a ceiling structure. Attachment of the planks 10 to the ceiling joists 40 with screws and nails one may prevent lateral motion, but such fastening requires considerable work in fixing the planks 10 to the joists or beams 40 and more work when removing them. With the present invention, as will be shown, installation and removal of the planks 10 is as simple as mere roll-out to install and rollup to remove. No installation tools or hardware is required. However, it may be desirable to tack the first and the last plank in place for improved permanency.

As shown in FIG. 2, notches 12N may be placed at the very ends of planks 10. Alternately, as shown in FIGS. 3 and 4, notches 12N may be placed at locations other then at the ends of the planks 10 including medially. From this it is clear that notches 12N may be U-shaped, or L-shaped.

As shown in FIG. 4, planks 10 may be used to span three or more of the beams 40. However, wider assemblies may be too heavy and unwieldy to manipulate during installation and removal, and cumbersome also for storing when not in use or when transporting. A better solution may be to place two or more of a narrower assembly in a side by side relationship, such as shown in FIGS. 2 and 5, in order to cover a larger surface area within an attic. In FIG. 2 we see that the top beam surface 42 is common to two side-by-side plank assemblies, and surface 42 has a width sufficient for simultaneously resting the ends of two collinearly aligned said planks 10. In FIG. 5, when the common beam 40 is not wide enough, or when greater overlap of the ends of planks 10 is desired, the solution lies in providing a spacing between planks 10 that is equal to, or greater, then the width of each of the planks 10.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A self-stabilized roll-out attic flooring and support structure comprising:

a horizontally oriented, beam extending in a longitudinal direction;

a longitudinally directed plurality of laterally oriented planks, the planks laying across and resting on top of the beam;

a longitudinally oriented strip of a flexible material fastened to the planks thereby securing the planks as an integral assembly;

wherein, a plank of the plurality of planks has a notch engaging the beam and thereby preventing lateral movement of the plank relative to the beam.

2. The support structure of claim 1 wherein the notch is L-shaped and positioned at one end of the plank in contact with the beam.

3. The support structure of claim 1 wherein the notch is U-shaped, the beam engaged within the notch.

4. The support structure of claim 1 further comprising a flexible strap joined at one end of the plurality of planks in a loop functional as a shoulder strap.

5. The support structure of claim 1 further comprising a further flexible strap joined to at least one of the planks, the further flexible strap positionable and fastenable circumferentially about the planks when the planks are mutually coiled into a bundle.

6. A self-stabilized roll-out attic flooring for placement on top of an attic beam, the flooring comprising:

a longitudinally directed plurality of laterally oriented planks;

a longitudinally oriented strip of a flexible material fastened to the planks thereby securing the planks as an integral assembly;

wherein, a plank of the plurality of planks has a longitudinally oriented bottom surface notch for engaging the beam and thereby preventing lateral movement of the plank relative to the beam;

wherein, each plank has an L-shaped edge notch positioned along each of opposing edges of the plank, one said L-shaped edge notch contiguous with a top surface of the plank, and one said L-shaped edge notch contiguous with a bottom surface of the plank;

whereby with the planks arranged so that each L-shaped edge notch that is contiguous with a top surface of one of the planks is engaged with each L-shaped edge notch that is contiguous with a bottom surface of an adjacent one of the planks, load forced applied to the planks are distributed from each one of the planks to each adjacent one of the plank.

7. The support structure of claim 6 wherein the bottom surface notch is L-shaped and positioned at one end of the plank in contact with the beam.

8. The support structure of claim 6 wherein the bottom surface notch is U-shaped, the beam engaged within the notch.

9. The support structure of claim 6 further comprising a flexible strap joined at one end of the plurality of planks in a loop functional as a shoulder strap.

10. The support structure of claim 6 further comprising a further flexible strap joined to at least one of the planks, the further flexible strap positionable and fastenable circumferentially about the planks when the planks are mutually coiled into a bundle.

* * * * *